US010483021B2

(12) United States Patent
Ernst et al.

(10) Patent No.: US 10,483,021 B2
(45) Date of Patent: Nov. 19, 2019

(54) CABLE WITH A CARBONIZED INSULATOR AND METHOD FOR PRODUCING SUCH A CABLE

(71) Applicant: LEONI KABEL GMBH, Nuremberg (DE)

(72) Inventors: Christian Ernst, Weissenburg (DE); Sebastian Goss, Roth (DE)

(73) Assignee: LEONI Kabel GmbH, Nuremberg (DE)

( * ) Notice: Subject to any disclaimer, the term of this patent is extended or adjusted under 35 U.S.C. 154(b) by 0 days.

(21) Appl. No.: 15/835,675

(22) Filed: Dec. 8, 2017

(65) Prior Publication Data

US 2018/0166187 A1 Jun. 14, 2018

(30) Foreign Application Priority Data

Dec. 8, 2016 (DE) ..... 10 2016 224 415

(51) Int. Cl.
*H01B 11/18* (2006.01)
*H01B 11/10* (2006.01)
*H01B 13/00* (2006.01)

(52) U.S. Cl.
CPC ..... *H01B 11/1821* (2013.01); *H01B 11/1066* (2013.01); *H01B 11/1839* (2013.01); *H01B 11/1852* (2013.01); *H01B 11/1808* (2013.01); *H01B 13/0026* (2013.01)

(58) Field of Classification Search
None
See application file for complete search history.

(56) References Cited

U.S. PATENT DOCUMENTS 2,211,584 A * 8/1940 Ruben ..... H01B 11/1817 174/102 C
3,297,814 A * 1/1967 McClean ..... G02B 6/4425 174/106 R
3,496,281 A * 2/1970 McMahon ..... H01B 7/0241 174/102 R
4,029,830 A * 6/1977 Yamamoto ..... H01B 7/0275 427/487
4,314,737 A * 2/1982 Bogese ..... H01B 7/0823 439/425
4,383,725 A * 5/1983 Bogese ..... H01B 7/0823 439/391
4,757,297 A * 7/1988 Frawley ..... H01B 7/0063 174/36

(Continued)

FOREIGN PATENT DOCUMENTS

DE 1021042 A 12/1957
DE 102008021204 A1 11/2009

(Continued)

*Primary Examiner* — Dimary S Lopez Cruz
*Assistant Examiner* — Muhammed Azam
(74) *Attorney, Agent, or Firm* — Laurence A. Greenberg; Werner H. Stemer; Ralph E. Locher

(57) ABSTRACT

A cable is specified, specifically for a signal line, which extends in a longitudinal direction and which includes an inner conductor and also an outer conductor. Between the inner conductor and the outer conductor there is formed an insulating material which surrounds the inner conductor and which has a surface that has been at least partially carbonized. Furthermore, a production method for such a line is specified.

19 Claims, 2 Drawing Sheets

(56) References Cited

U.S. PATENT DOCUMENTS

| | | | | |
|---|---|---|---|---|
| 5,170,010 | A * | 12/1992 | Aldissi | H01B 11/1066 174/106 R |
| 5,262,591 | A * | 11/1993 | Aldissi | C08K 3/24 174/106 SC |
| 5,470,657 | A * | 11/1995 | Hayami | H01B 3/441 174/110 PM |
| 5,554,236 | A * | 9/1996 | Singles | H01B 11/1066 156/229 |
| 5,597,981 | A * | 1/1997 | Hinoshita | H01B 7/295 174/110 PM |
| 6,239,376 | B1 * | 5/2001 | Kimura | H01B 7/38 174/110 R |
| 7,889,959 | B2 * | 2/2011 | Pellen | H01B 3/28 385/102 |
| 2007/0272430 | A1 * | 11/2007 | Tuffile | H01B 11/1008 174/102 R |
| 2014/0238722 | A1 | 8/2014 | Hayashishita et al. | |
| 2016/0111185 | A1 * | 4/2016 | Friberg | G02B 6/4419 385/101 |
| 2017/0098492 | A1 * | 4/2017 | Iwasaki | H01B 3/28 |
| 2018/0166187 | A1 * | 6/2018 | Ernst | H01B 11/1821 |
| 2018/0247738 | A1 * | 8/2018 | Kibe | H01B 7/0225 |

FOREIGN PATENT DOCUMENTS

| | | | |
|---|---|---|---|
| EP | 2637178 | A2 | 9/2013 |
| GB | 739962 | A | 11/1955 |
| GB | 1316164 | A | 5/1973 |
| JP | H11149830 | A | 6/1999 |
| WO | 9417534 | A1 | 8/1994 |

* cited by examiner

CABLE WITH A CARBONIZED INSULATOR AND METHOD FOR PRODUCING SUCH A CABLE

CROSS-REFERENCE TO RELATED APPLICATION

This application claims the benefit, under 35 U.S.C. § 119, of German patent application DE 10 2016 224 415.9, filed Dec. 8, 2016; the prior application is herewith incorporated by reference in its entirety.

BACKGROUND OF THE INVENTION

Field of the Invention

The invention relates to a cable, in particular a signal cable, and also to a method for producing such a cable. The device may also be referred to as a cord or as a line.

A cable has at least one conductor which is surrounded by an insulation consisting of an insulating material. The conductor and the insulation form, in particular, a core. In many types of cables, or cords or lines, an additional conductor is arranged around this arrangement by way of outer conductor, for instance in the case of shielded cores or in the case of coaxial cables. Such cables are routinely employed as signal lines, for instance in the field of sensorics, where they serve for the transmission of signals.

A significant parameter for cables is the level of microphonic noise—that is to say, the susceptibility to the microphonic effect. The effect is known, in particular, in connection with the transmission of audio signals. In the case of this effect, mechanical loadings of the cable are converted into electrical signals. The underlying cause of this is, in particular, charge generation by reason of the conductor as such. The conductor consists of a conducting material—ordinarily, copper—and, due to its manufacture, exhibits partially crystalline regions which generate electrical charges upon loading or crimping. But, in addition to this microphonic noise, electrical charges also arise in the event of the conductor and the insulating material rubbing against one another, for example as a consequence of movement or loading of the cable. These two mechanisms generally result in the generation of charges, actually a charge separation, which in turn generate interferences, more precisely electrical interferences. These have a disadvantageous effect on the transmission properties of the line. This is particularly critical in the case of signal lines, for instance in the automotive field or in medical engineering where ordinarily a high transmission quality is demanded for cables that are routinely subject to mechanical loading.

SUMMARY OF THE INVENTION

It is accordingly an object of the invention to provide a cable and a method of producing a cable which overcome the above-mentioned and other disadvantages of the heretofore-known devices and methods of this general type and which specify a cable in which electrical interferences by reason of mechanical loading are reduced as much as possible. Furthermore, a production method for such a cable is to be specified.

With the foregoing and other objects in view there is provided, in accordance with the invention, a cable, in particular a signal cable, comprising:

an inner conductor and an outer conductor extending in a longitudinal direction of the cable; and an insulating material disposed between the inner conductor and the outer conductor, and surrounding the inner conductor, the insulating material having a surface that is at least partially carbonized.

The cable is, in particular, a signal line—that is to say, it is used for the transmission of signals. The cable extends in a longitudinal direction and comprises an inner conductor and also an outer conductor. These each consist, in particular, of a conducting material, for example copper. An insulating material is arranged between the inner conductor and the outer conductor. This material has been produced from an insulating and therefore electrically non-conducting material, in particular a synthetic material. The insulating material has preferentially been extruded onto the inner conductor by way of insulation. The insulating material expediently surrounds the inner conductor over its full periphery—that is to say, as a rigid sheath. Generally, the insulating material forms a sheath around the inner conductor. The insulating material on the inner conductor exhibits a surface. This surface has been at least partially carbonized—that is to say, the insulating material was at least partially carbonized by carbonization and thereby transformed.

A central concept of the invention consists, in particular, in making the actually non-conducting insulating material conductive to a certain degree, in order to conduct away or to neutralize electrical interferences. In principle, it is possible to use a conducting, semiconducting or weakly conducting insulating material from the outset, for example a conductive synthetic material. However, such a material is ordinarily expensive and/or requires an additional extrusion step and is therefore unsuitable for mass production, particularly in the automotive field. Alternatively, it is conceivable to admix conductive particles—for example, carbon black—to the insulating material, or to apply such particles. However, this requires a corresponding additional process step and also, under certain circumstances, an elaborate handling of the particles.

In contrast, in the present case conductivity of the insulating material is achieved in particularly simple manner by carbonization of the insulating material that is present anyway—that is to say, in particular, by a combustion process in which the surface is burnt—that is to say, carbonized—in particular by supply of thermal energy. In particular, a separate application of a carbonized material after the application of the insulating material is also dispensed with. In other words: it is not the case that the insulating material is firstly applied and then a carbonized material is additionally applied onto said material, but instead the carbonized material is formed from the insulating material itself. In this context, a part of the insulating material is purposefully carbonized and thereby, in particular, destroyed, in the course of which conductive carbon particles are generated. Accordingly, no additional material is added, but instead the originally insulating insulation material is transformed, in order to obtain conductive material. In other words: an admixture of additional, carbonized particles to the insulating material is preferentially dispensed with; similarly, a separate application of additional, carbonized particles to the insulating material is preferentially dispensed with. In contrast to this, instead the insulating material itself is carbonized—to be specific, afterwards. In the course of production of the cable the insulating material is firstly applied and is carbonized only thereafter.

The carbonization is effected on the surface of the insulating material, i.e., on a surface facing outward with respect to the inner conductor. The carbonization is preferentially effected in this case merely to a particular depth of penetration which, in particular, amounts to merely a few micrometers, in particular less than 100 μm. Accordingly, a merely superficial carbonization is effected—that is to say, in particular to a depth of 100 μm into the insulating material. The carbonization is consequently a surface treatment. Lower-lying regions of the insulating material, which are also designated as an interior of the insulating sheath, are spared—that is to say, they are not carbonized. Consequently the insulating material is, apart from the surface, in particular free from carbonization or from carbonized particles. This is achieved, in particular, by virtue of the fact that the surface is carbonized afterwards, so that in the finished cable merely the surface has then been carbonized, and no carbonized particles are present in the interior of the insulating material.

By virtue of the carbonized surface, i.e., the partially carbonized insulating material, and the conductivity thereby achieved, electrical interferences by reason of charge separation in the case of mechanical loading are reduced particularly effectively. At the same time, the cable can be produced particularly simply and inexpensively. The establishment of a certain conductivity of the surface is advantageously effected without supply of additional material, and in a simple process step. An admixture of conducting material is not required; rather, such material is advantageously generated directly. An admixture of conductive or carbonized material to the insulating material is preferentially dispensed with. The conductivity of the surface is preferentially achieved merely by a subsequent carbonization.

Correspondingly, in the case of a method for producing the cable an inner conductor is surrounded by an insulating material, a surface of the insulating material is at least partially carbonized, and the insulating material is surrounded by an outer conductor. Production is preferentially effected in the stated sequence. The insulating material is firstly applied onto the inner conductor, is preferentially extruded on, and subsequently the surface is carbonized. In the course of carbonizing, the insulating material has expediently already cooled or at least hardened in such a manner that an intermixing of the insulating material in the course of carbonizing is prevented. After this, the outer conductor is arranged around the insulating material and the inner conductor.

The insulating material has preferentially been carbonized by a thermal treatment—that is to say, by supply of thermal energy, also designated as combustion. Laser radiation is particularly suitable for this purpose, so the insulating material has preferentially been carbonized by means of laser radiation, in particular infrared laser radiation. In other words: the surface is carbonized by means of a laser, in particular an infrared laser. A laser is particularly suitable for carbonization, since with this the surface of the insulating material can be processed purposefully. Through use of laser radiation, a surface treatment has accordingly been realized in simple manner. Laser radiation can, in addition, be applied onto the surface particularly simply, since a laser beam is simple to control and deflect. In particular, with a laser a treatment merely of the surface is also possible—that is to say, damage to parts situated further inside is advantageously prevented. The interior of the insulating material remains unaffected and has therefore not been carbonized.

A simple admixture of carbonized material—that is to say, of carbonized particles—typically leads to a homogeneous distribution of these particles in the insulating material, so that the individual particles are insulated from one another. In contrast, in the present case by virtue of the subsequent carbonization the carbonized particles are, in particular, formed contiguously and then form, as a whole, carbonized portions with a high concentration of carbonized particles in comparison with non-carbonized portions. By virtue of the fact that the carbonized particles are not being admixed and mixed with the remaining insulating material and distributed therein, a particularly high conductivity advantageously also arises for the carbonized portions.

Quire particularly suitable is an infrared laser—that is to say, a laser that emits laser radiation within the infrared range, that is, in particular with a wavelength from at least 750 μm to, for example, 10.6 μm. To this extent, a labeling laser is particularly suitable. For instance, a $CO_2$ laser is suitable. Infrared laser radiation advantageously results in the intended carbonization, whereas ultraviolet laser radiation, for instance, is unsuitable for this. Infrared laser radiation also has a lower depth of penetration into the insulating material than, for example, ultraviolet laser radiation, as a result of which possible damage to the inner conductor is avoided.

The carbonization is expediently effected in a protective atmosphere. As a result, it is advantageously ensured that in the course of combustion of the insulating material the carbon arising does not react with atmospheric oxygen to form carbon dioxide and/or carbon monoxide and volatilizes, but instead is preserved as solid matter. In the course of production of the cable the sheathed inner conductor is, for instance, conducted through a tube that has been flooded with a protective gas, for example nitrogen or argon.

In principle, other radiation sources are also suitable for carbonization. For instance, instead of a laser an LED arrangement with appropriate power density would be conceivable in order to carbonize the insulating material. Microwave radiation is also suitable in principle, but ordinarily it has a greater depth of penetration.

By way of insulating materials, in particular in connection with carbonization by means of laser radiation, all materials are suitable in principle that are used conventionally as insulation or sheath for a conductor. Particularly preferred, however, are PP or PE, since these can be processed particularly inexpensively and also easily. In contrast, less preferred but also suitable in principle are fluorine-containing synthetic materials which in the course of carbonizing possibly release fluorine and therefore require special safety measures in the course of production of the line.

In a suitable configuration, the surface has been completely carbonized at least intermittently—that is to say, merely on a longitudinal portion of the line. As a result, the microphonic effect is reduced particularly intensely—that is to say, the cable is particularly low in microphonic noise. Such a cable is particularly suitable as a signal line for low-frequency signals—that is to say, in particular for frequencies up to 100 kHz. For this purpose, the surface has been carbonized uninterruptedly along a longitudinal portion of the line, so that the surface accordingly takes the form of a full-periphery, uninterrupted conductive layer. Any charges that are generated by mechanical loading of the cable are discharged efficiently.

In order to carbonize the surface completely, use is preferentially made of a laser in rotating arrangement—that is to say, a rotating laser—in the course of production. As a result, the insulating material is subjected to laser radiation from all sides in the radial direction, without having to rotate the cable as such.

A particular advantage of the direct generation of the conducting material is that said material can be generated at the same time also in location-selective manner and, as a result, a structure consisting of conducting material can also be generated correspondingly. In contrast to the aforementioned complete carbonization, in a particularly advantageous configuration the surface has therefore been merely partially carbonized, at least intermittently, and a particularly conductive structure has been formed on the surface. In other words: the surface has merely been partially carbonized on a longitudinal portion of the line, and as a result a structure has been formed on this longitudinal portion. By appropriate design of this structure, the electrical properties of the cable can be adjusted purposefully, and interference effects can also be purposefully minimized. The surface is then carbonized merely in location-selective manner, and in this way a structure is formed. The use of a laser is particularly advantageous here, since microscopic structures—that is to say, microstructures or even structures having dimensions within the micrometer range—can also be produced with this, as a result of which a large number of design options arise. The charges generated by mechanical loading of the cable are then discharged or neutralized by a suitably designed structure—that is to say, cable structure. Such a structure, in particular a microstructure, is particularly advantageous for a cable taking the form of a coaxial cable that is used for the transmission of signals within the high-frequency range—that is to say, at frequencies above 100 kHz, especially above 1 GHz.

In a basically suitable configuration, the surface has been completely carbonized and then exhibits no non-carbonized portions. In a likewise suitable variant, the surface has merely been partially carbonized and then exhibits portions that have not been carbonized and that are consequently free from carbonized particles.

The surface along the entire cable has suitably been either completely carbonized or, for the purpose of forming a structure, merely partially carbonized. As a result, the respective advantageous effects are achieved along the entire line. In an advantageous variant, however, a complete carbonization is combined with a merely partial carbonization of the surface, so that the cable exhibits a first longitudinal portion, along which the surface of the insulating material has been completely carbonized, and a second longitudinal portion, along which the surface of the insulating structure has been merely partially carbonized and formed with a structure. The first longitudinal portion has accordingly been carbonized completely, and the second longitudinal portion merely partially. Such a cable is, in particular, a sensor for mechanical loading, for example flexure. The consideration that underlies this is that mechanical loading acts differently on the two longitudinal portions. In this way, the microphonic effect is reduced particularly effectively on the completely carbonized longitudinal portion, at any rate better than on the merely partially carbonized longitudinal portion. Put the other way round, by virtue of the structure on the merely partially carbonized longitudinal portion the transmission of high-frequency signals is distinctly improved. By suitable measurement, it is then advantageously possible to localize a corresponding mechanical action, since locally the cable reacts differently to such an action.

Particularly preferred is a configuration in which the structure takes the form of a filter structure, in particular for frequency-selective suppression of interference signals. In this connection, the structure forms a filter for electrical signals, which is expediently designed in such a manner that unwanted interference signals are suppressed, in particular annihilated. Useful signals that are to be transmitted by the line, however, are affected as little as possible. Charges that are generated by friction of the various materials of the cable on one another result in interference signals between the inner conductor and the outer conductor, which in turn are annihilated efficiently by the intermediate carbonized surface. For this purpose, the structure takes the form, in particular, of an attenuating filter for the interference signals.

In order to achieve a particularly optimal and uniform action, in particular along the entire line, the structure has expediently been formed periodically in the longitudinal direction. The structure accordingly forms an arrangement consisting of several similar portions which are arranged in series in the longitudinal direction. In particular in the configuration as a filter structure, a particularly effective filter action, and consequently a particularly strong attenuation of interference signals, is guaranteed by this means.

In a suitable configuration, the structure exhibits several transverse tracks which extend at right angles to the longitudinal direction. The expression "at right angles" is to be understood as "perpendicular.". In one configuration, the transverse tracks each take the form of a ring which runs around the insulating material, in particular over the full periphery. Alternatively or additionally, the structure is spiral-like or helical and then extends in a manner wound around the insulating material. The transverse tracks, in pairs, form capacitors in particular, by means of which an advantageous filter action is achieved. In the helical, or helix-like, configuration, in addition an inductance is also realized in particular, so that the structure as a whole acts like an oscillating circuit. By suitable dimensioning of the transverse tracks and by suitable design of the course thereof, the electrical properties of the cable can then be purposefully manipulated, and interference signals can be effectively suppressed.

Advantageously, the structure extends in meandering manner in the longitudinal direction. It is understood by this, in particular, that the structure exhibits several transverse tracks which have precisely not been formed over the full periphery but rather each exhibit two ends, via which a respective transverse track is connected to the two adjacent transverse tracks, the one end being connected to the preceding transverse track, and the other end to the succeeding transverse track. The transverse tracks have consequently been connected so as to form a common principal track. As a result, a course arises in the manner of a square-wave signal, for instance. Also suitable is a meandering course in the manner of a sawtooth signal or sinusoidal signal.

In an advantageous further development, the structure exhibits at least one principal track, proceeding from which a large number of transverse ribs extend at right angles to the longitudinal direction. The principal track is either straight or meandering, as described above. The transverse ribs are each connected to the principal track but are preferentially not connected amongst themselves. In this way, the transverse ribs form a ramification proceeding from the principal track. By virtue of the combination of a principal track with additional transverse ribs, further design options arise for the electrical properties of the structure and consequently of the line. For instance, the principal track serves for filtering—that is to say, in particular, attenuation—of a particular principal frequency, and the transverse ribs form filter substructures, by means of which further frequencies, in particular secondary frequencies or sub-bands, are filtered—that is to say, in particular, attenuated.

In a particularly suitable further development, two principal tracks have been formed, each with a large number of transverse ribs which are arranged alternately in the longitudinal direction and engage one another. As a result, a particularly extensive filter action is achieved, and a large number of different interference signals are suppressed or neutralized. The two principal tracks have been electrically connected to their respective transverse ribs. However, the principal tracks have precisely not been electrically connected to one another, and neither have the transverse ribs of the differing principal tracks. In this way, two partial structures have accordingly been formed which have not been electrically connected to one another—that is to say, the two partial structures are separated and spaced from one another by non-carbonized regions of the surface. By virtue of the transverse ribs engaging one another, a large number of capacitors have then been formed which have been interconnected via the principal tracks.

In a suitable configuration, the one principal track has been formed in meandering manner, in particular in the manner of a square-wave signal, and the other principal track has been formed precisely along the longitudinal direction.

Crucial for the action, in particular the filter action, of the structure are the dimensions thereof—that is to say, the width of the principal tracks, transverse tracks and transverse ribs and also the spacings thereof, in particular longitudinal spacings, from one another. The dimensions are expediently matched to the interference signals to be filtered in the given case. In the case of cables for signal transmission within the high-frequency range, in particular from 1 GHz, the dimensions are routinely chosen within the micrometer to centimeter range. The longitudinal spacing of two adjacent transverse ribs preferentially amounts to between 1 μm and 50 cm. The width of a principal track, transverse track or transverse rib is expediently distinctly smaller than the longitudinal spacing and, for instance, amounts to between 1 and 100 μm. In this connection, the transverse ribs are, in particular, narrower than the principal tracks and transverse tracks, for instance by a factor of 10, in order to achieve a density that is as high as possible. Such microscopically dimensioned structures can be produced particularly advantageously with a laser.

In an advantageous configuration, a further insulating material has been applied onto the insulating material, as a result of which an insulation has been formed in which the carbonized surface is embedded. After the application of the further insulating material, the surface is then, strictly speaking, no longer a surface. Rather, a conducting layer or structural layer has been formed which is embedded in the insulation—that is to say, is embedded between two layers of insulating material. As a result, the conductive particles and the structure generated therefrom where appropriate are particularly well protected and, in particular, not in contact with the outer conductor, so that possible abrasion of the carbonized surface or damage to the structure is prevented. By way of further insulating material, use is preferentially made of the same material as already used previously by way of insulating material, so that the insulation as a whole consists merely of this material and also of the carbonization products obtained from said material by carbonization. The two layers of the insulation are expediently connected to one another by adhesive closure.

In a first preferred configuration, the cable takes the form of a coaxial cable, in particular for signal transmission, in which case the insulating material serves as dielectric. The inner conductor is then the inner conductor of the coaxial line; the outer conductor correspondingly the outer conductor. The inner conductor has, for instance, been formed in solid manner or as a stranded conductor. An outer sheath is expediently arranged around the entire arrangement.

In a second preferred configuration, the cable takes the form of a shielded core, in particular for signal transmission, in which case the insulating material is a core sheath, and in which case the outer conductor is a shielding. The inner conductor has, for instance, been formed in solid manner or as a stranded conductor. The outer conductor takes the form, for instance, of a foil shield or braided shield. An outer sheath is expediently arranged around the arrangement.

Other features which are considered as characteristic for the invention are set forth in the appended claims.

Although the invention is illustrated and described herein as embodied in a cable and method for producing such a device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
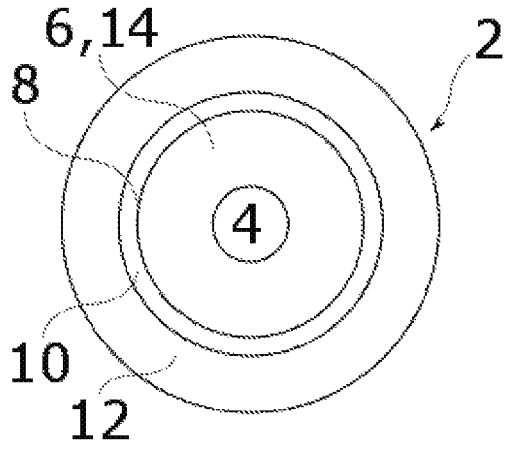
FIG. 1 is a cross-sectional view of the cable according to the invention.

Referring now to the figures of the drawing in detail and first, particularly, to FIG. 1 thereof, there is shown a cable 2 in a cross-section with respect to the longitudinal direction R thereof. The cable 2 has an inner conductor 4 which, for instance, is solid or a stranded conductor. The inner conductor 4 is surrounded by an insulating material 6. This material forms a sheath or rigid sheath for the inner conductor 4. The insulating material 6 has a surface 8 which faces outward with respect to the inner conductor 4. Furthermore, an outer conductor 10 is arranged around the inner conductor 4 and the insulating material 6. In a variant, the cable 2 is a shielded core. The outer conductor 10 then takes the form of a shielding. In another variant, the cable 2 is a coaxial cable. The outer conductor 10 then takes the form of a foil conductor, for example; the insulating material 6 serves as dielectric. Here, in addition, an outer sheath 12 is arranged around the aforementioned components. In variants that are not shown, yet further sheaths, conductors, layers or similar are arranged. In a preferred but non-illustrated variant, additional insulating material 6 is arranged between the outer conductor 10 and the insulating material 6, so that the surface 8 does not abut the outer conductor 10 but rather is embedded in an insulation 14 of the inner conductor 4. Also in the variant shown in FIG. 1, the insulating material 6 forms an insulation 14 of the inner conductor 4.

For the purpose of improving the electrical properties, in particular for the purpose of diminishing electrical interference effects, the surface 8 has been at least partially carbonized. This is effected as illustrated in FIG. 2, for instance.

A method for producing the cable 2 is shown therein. In this case, the inner conductor 4 is supplied to an extrusion plant 16, by means of which the insulating material 6 is extruded onto the inner conductor 4, i.e., the inner conductor is sheathed, that is, surrounded, with insulating material 6. Subsequently the sheathed inner conductor 4 undergoes aftertreatment with a laser 18. In this process, laser radiation L is applied onto the surface 8, and the latter is thereby carbonized. The insulating material 6 burns, in the course of which conductive particles consisting of carbon are produced. In order to prohibit volatilization of the carbon by reaction with atmospheric oxygen, the carbonization is effected in a protective atmosphere S within a tube 20, through which the sheathed inner conductor 4 is guided. The laser 18 here is an infrared laser, which is particularly suitable for carbonizing the insulating material 6.

Figure 2:
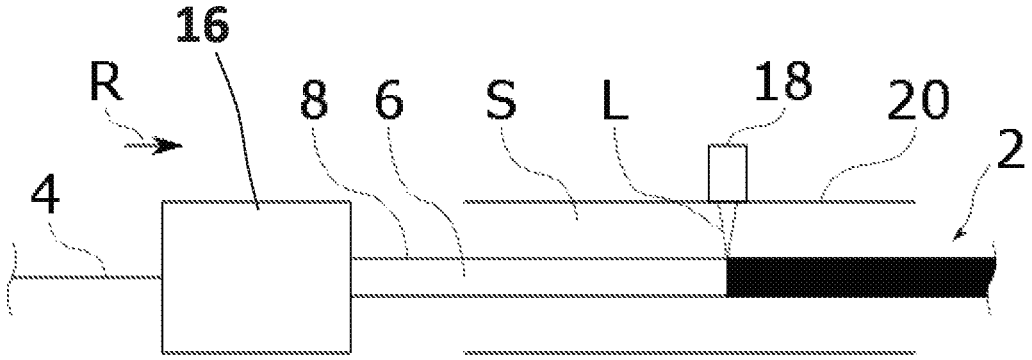
FIG. 2 is an illustration of a production method for the cable.

In FIG. 2 the surface 8 is carbonized completely. The resulting cable 2 is then particularly low in microphonic noise. However, particularly in the case where use is made of a laser 18 for the purpose of carbonization, a structure 22 can also be formed—that is to say, the surface 8 is merely partially carbonized. As a result, the electrical properties of the cable 2 can be optimized. This is particularly advantageous in the case of a coaxial cable that is used for the transmission of signals at high frequencies, for instance above 100 kHz, especially above 1 GHz. The structure 22 can then be formed as a filter structure and filters out particular interference signals—that is to say, it attenuates them—so that the transmission properties of the cable 2 have been distinctly improved.

Figure 3:
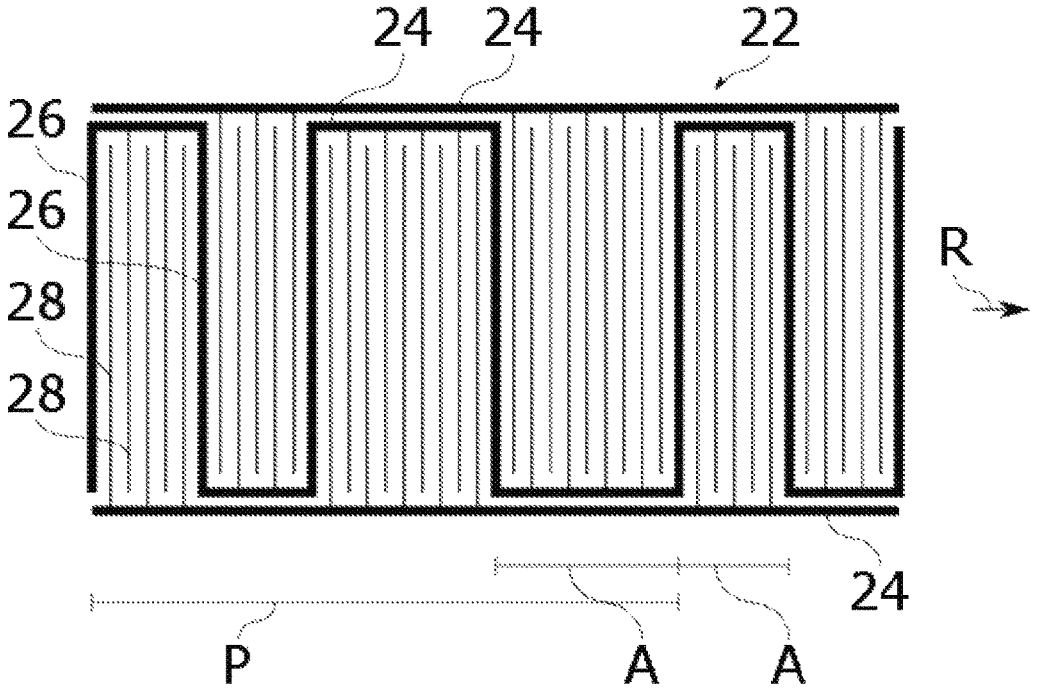
FIG. 3 is a partial developed view of a filter structure for the line.

A merely exemplary structure 22 is illustrated in FIG. 3. The representation in this case is such that the surface 8 has been cut open and unwound in the longitudinal direction R, in order to enable a complete representation in the plane. The structure 22 which is shown then extends around the insulating material in such a manner that the upper edge and lower edge of the structure 22 adjoin one another.

The structure 22 shown in FIG. 3 exhibits several, here three, principal tracks 24, one of which extends in meandering manner, here in the manner of a square-wave signal. The meandering principal track 24 in this case exhibits transverse tracks 26 which extend perpendicularly with respect to the longitudinal direction R and are connected amongst themselves so as to form the rectangular shape. The transverse tracks 26 are arranged at varying spacings A from one another. In a variant, the structure 22 has been formed in such a manner that the two principal tracks 24 extending in straight lines abut one another directly on the upper and lower edges of the structure 22 and jointly form a principal track 24.

Proceeding from the principal tracks 24, in each instance a large number of transverse ribs 28 have been formed which, like the transverse tracks 26, extend perpendicularly with respect to the longitudinal direction R and thereby form a ramification of the principal tracks 24. The transverse ribs 28 of the various principal tracks 24 engage one another, so that a comb structure has been formed. The transverse ribs 28 here are equally spaced from one another in each instance; however, this is not mandatory.

The entire structure 22 in the present case is also periodic and consists of similar portions with a period P, which are arranged in series in the longitudinal direction R.

Figure 4:
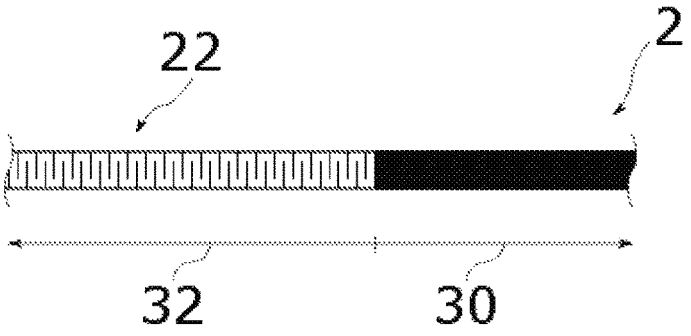
FIG. 4 is a side view of a variant of the cable.

In FIG. 4 a variant of the cable 2 is shown which includes a first longitudinal portion 30, along which the surface 8 of the insulating material 6 has been completely carbonized, and a second longitudinal portion 32, along which the surface 8 of the insulating structure 6 has been merely partially carbonized and formed with a structure 22. The longitudinal portions 30, 32 have been formed in series in the longitudinal direction R. This cable 2 is particularly suitable as a sensor, since the differing line portions 30, 32 react differently to interferences, as a result of which such interferences can be localized.

The invention claimed is:

1. A cable, comprising:

an inner conductor and an outer conductor extending in a longitudinal direction of the cable; and an insulating material disposed between said inner conductor and said outer conductor, and surrounding said inner conductor, said insulating material having a surface that is partially carbonized at least intermittently, and wherein a structure is formed on said surface.

2. The cable according to claim 1, wherein said surface of said insulating material has the characteristics of having been carbonized by laser irradiation.

3. The cable according to claim 2, wherein a carbonization of said surface is formed by infrared laser radiation.

4. The cable according to claim 1, wherein said surface is completely carbonized at least in segments thereof.

5. A method for producing a cable, comprising:

surrounding an inner conductor with an insulating material;

partially carbonizing a surface of the insulating material at least intermittently, and forming a structure on the surface; and surrounding the insulating material with an outer conductor.

6. The cable according to claim 1, wherein said structure is a conductive structure.

7. The cable according to claim 1, comprising a first longitudinal portion, along which said surface of said insulating material has been completely carbonized, and a second longitudinal portion, along which said surface of said insulating structure has been merely partially carbonized and formed with said structure.

8. The cable according to claim 1, wherein said structure is a filter structure.

9. The cable according to claim 1, wherein said structure has been formed periodically in the longitudinal direction.

10. The cable according to claim 1, wherein said structure is formed with a plurality of transverse tracks which extend at right angles to the longitudinal direction.

11. The cable according to claim 1, wherein said structure extends in meandering path in the longitudinal direction.

12. The cable according to claim 1, wherein said structure is formed with a principal track, proceeding from which a multiplicity of transverse ribs extend at right angles to the longitudinal direction.

13. The cable according to claim 12, wherein said principal track is one of at least two principal tracks each having been formed with a multiplicity of transverse ribs which are arranged alternately in the longitudinal direction and engage one another.

14. The cable according to claim 1, which comprises a further insulating material applied over said insulating material and embedding said at least partially carbonized surface and forming an insulation with an embedded carbonized layer.

15. The cable according to claim 1, formed as a coaxial cable wherein said insulating material serves as a dielectric.

16. The cable according to claim 1, formed as a shielded core wherein said insulating material is a core sheath and said outer conductor is a shielding.

17. The cable according to claim 1, formed as a signal conducting line.

18. The method according to claim 5, which comprises carbonizing the surface with a laser.

19. The method according to claim 18, which comprises carbonizing the surface with an infrared laser.

* * * * *